US005310255A

United States Patent [19]

Ranallo

[11] Patent Number: 5,310,255

[45] Date of Patent: May 10, 1994

[54] ADJUSTABLE DRAWER GUIDE MOUNTING APPARATUS

[76] Inventor: Paul A. Ranallo, 19915 County Rd. 81, Osseo, Minn. 55369

[21] Appl. No.: 885,148

[22] Filed: May 18, 1992

[51] Int. Cl.[5] ..... A47B 96/00

[52] U.S. Cl. ..... 312/334.5; 312/334.1

[58] Field of Search ..... 312/334.5, 334.4, 334.1; 248/298, 241

[56] References Cited

U.S. PATENT DOCUMENTS

| | | | |
|---|---|---|---|
| 2,226,434 | 12/1940 | Hirsh | 312/334.5 |
| 2,494,221 | 1/1950 | Wojakowski | 312/334.5 |
| 2,928,696 | 3/1960 | Hiers | 312/334.4 |
| 4,711,538 | 12/1987 | Ohs et al. | 248/298 |
| 4,810,045 | 3/1989 | Lautenschlager . | |
| 4,834,555 | 5/1989 | Grass . | |

FOREIGN PATENT DOCUMENTS

| | | | |
|---|---|---|---|
| 235502 | 9/1964 | Fed. Rep. of Germany | 248/298 |

*Primary Examiner*—Kenneth J. Dorner
*Assistant Examiner*—Gerald A. Anderson
*Attorney, Agent, or Firm*—Moore & Hansen

[57] ABSTRACT

There is provided a drawer guide mounting assembly including a mounting bracket and an selectably positionable carriage that is slidingly engageable with the mounting bracket and that supports a drawer guide.

16 Claims, 1 Drawing Sheet

ADJUSTABLE DRAWER GUIDE MOUNTING APPARATUS

The present invention relates to apparatus for mounting cabinet drawer guides within a cabinet.

BACKGROUND OF THE INVENTION

Hand crafted wood cabinets are highly sought after by consumers. Because of the skill of the artisan involved in making such cabinets, they generally present a more aesthetically pleasing cabinet front and function much better overall than mass-produced cabinets. Part of this overall better function is dependant upon the mounting of the drawers within the cabinet for a smooth, reliable outward and inward sliding movement. A drawer track assembly functions both to support the drawer within the cabinet and facilitate the sliding action of the drawer into and out of the cabinet. Typically, such an assembly includes a drawer rail member attached to the drawer and a guide bar member attached to the wall of the cabinet. These members cooperate to support the drawer at a desired position, both vertically and horizontally, relative to the cabinet as well as provide sliding action therebetween so that the drawer may be slid into and out of the cabinet.

There are a variety of different drawer track assemblies available to the cabinet builder. For example, one such known assembly includes a pair of elongate rails that are mounted to opposing upright sides of the drawer with each rail carrying at least one rotatable wheel. Each wheel rotationally engages a guide that is in turn supported by the wall of the cabinet. In addition, at times at least one additional track is interposed between the described guide and rail.

Proper sliding motion of the drawer requires proper positioning of the various elements of each drawer track assembly. In a typical prior art cabinet, the drawer rail member is mounted to the exterior side wall of the drawer and the guide bar member is mounted either directly to the cabinet wall or to a shim or spacer that properly spaces the guide bar member from the side wall of the cabinet. The cabinet maker by the use of appropriately sized wooden shims or spacers is able to properly space the guide bar from the cabinet side wall so as to mount the drawer for sliding movement. Where cabinets have face frames, the guide bar is usually anchored in the front to the face frame. Since the back of the cabinet typically does not have the equivalent of a face frame to serve as an anchor, shims or spacers are usually required and typically take the form of an elongate, rectangular block of wood that is attached to the cabinet interior wall surface and runs substantially from the front to the rear of the cabinet along the interior wall surface. Standardization reduces the number of different block sizes needed for different size face frame margins, but still requires the artisan to cut the blocks precisely. These systems provide no easy adjustability in the positioning of the guide bar member that is attached to the cabinet. Additionally, fittings are often placed over the back end of the guide bar to constrain the movement of the drawer inwardly. Where shims or spacers have been used to mount the guide bar, attachment of the fitting can be difficult.

Prior art devices, other than wooden shims, for supporting a drawer track assembly do exist and are commercially available, but known devices are not readily adjustable. Furthermore, none of these devices are positionable on the interior side wall of the cabinet. The known devices must be mounted on the back wall of the cabinet or suspended by a hanger if there is no backwall. Additionally, they are not generally readily interchangeable between the left and right sides and therefore the cabinet maker must stock two different mounts if those devices are used in the construction of a cabinet.

While the above system for installing drawers in cabinets works well in the cabinet shop where the cabinet maker has complete control of the environment and the ability to keep the cabinet walls plumb and square, such is not always the case at the final installation site. That is, during the process of constructing the cabinet, the cabinet maker is able to maintain the walls positioned as desired and to attach the guide bar member in the proper location so that the drawer slides into and out of the cabinet properly. When the cabinet is installed at a building site, however, the floors and walls of the site may not be level or plumb. Shims will probably be used at the building site to level the cabinets relative to the building site, but the end result is that the cabinet walls may be shifted relative to each other to accommodate the geometry of the building site, which in turn may cause the drawer track assembly and thus the drawer to become misadjusted. The drawer, which at the cabinet shop once slid smoothly into and out of the cabinet, may now bind and slide grudgingly, thereby diminishing both the value of the cabinet and the cabinet maker's reputation in the eyes of the consumer.

It would be desirable to have an apparatus that would allow the drawer track assembly to be adjustably positioned within in the cabinet both during the crafting of the cabinet and, when necessary, later at the time of its installation at a building site, and furthermore that was useable without modification on both sides of the drawer to engage the drawer guide.

SUMMARY OF THE INVENTION

The present invention provides a drawer guide mounting apparatus that slidably supports the guide bar member and allows it to be positioned so as to perfectly support the drawer rail member and thus the drawer. The mounting apparatus includes a mounting bracket having first and second arms angularly disposed relative to one another. The first of the arms includes means for mounting the bracket to the interior wall surface of the cabinet so that the second arm extends inwardly from the cabinet wall. The mounting apparatus further includes a carriage that supports the guide bar and slides along the second arm so as to position the guide bar in the preferred position relative to the interior wall surface of the cabinet to match the margin of the face frame. Means for selectively securing the carriage to the second arm when the carriage is properly positioned is also disclosed.

In an embodiment of the invention shown herein, the securing means includes a flexible passage configured to slidably receive the second arm, and clamping means for clamping the flexible passage about the second arm so as to rigidly affix the carriage to the second arm in the desired position for proper drawer movement. The carriage further includes a receptacle for retaining the guide bar, allowing the guide bar to support the drawer rail in a conventional manner.

These and other features and advantages of the present invention will become apparent to those skilled in the art when the following detailed description of the invention is read in conjunction with the accompanying drawings and claims. Throughout the drawings, like numerals refer to similar or identical parts.

DETAILED DESCRIPTION OF THE INVENTION

Figures 1, 2, 3, 4, 5:
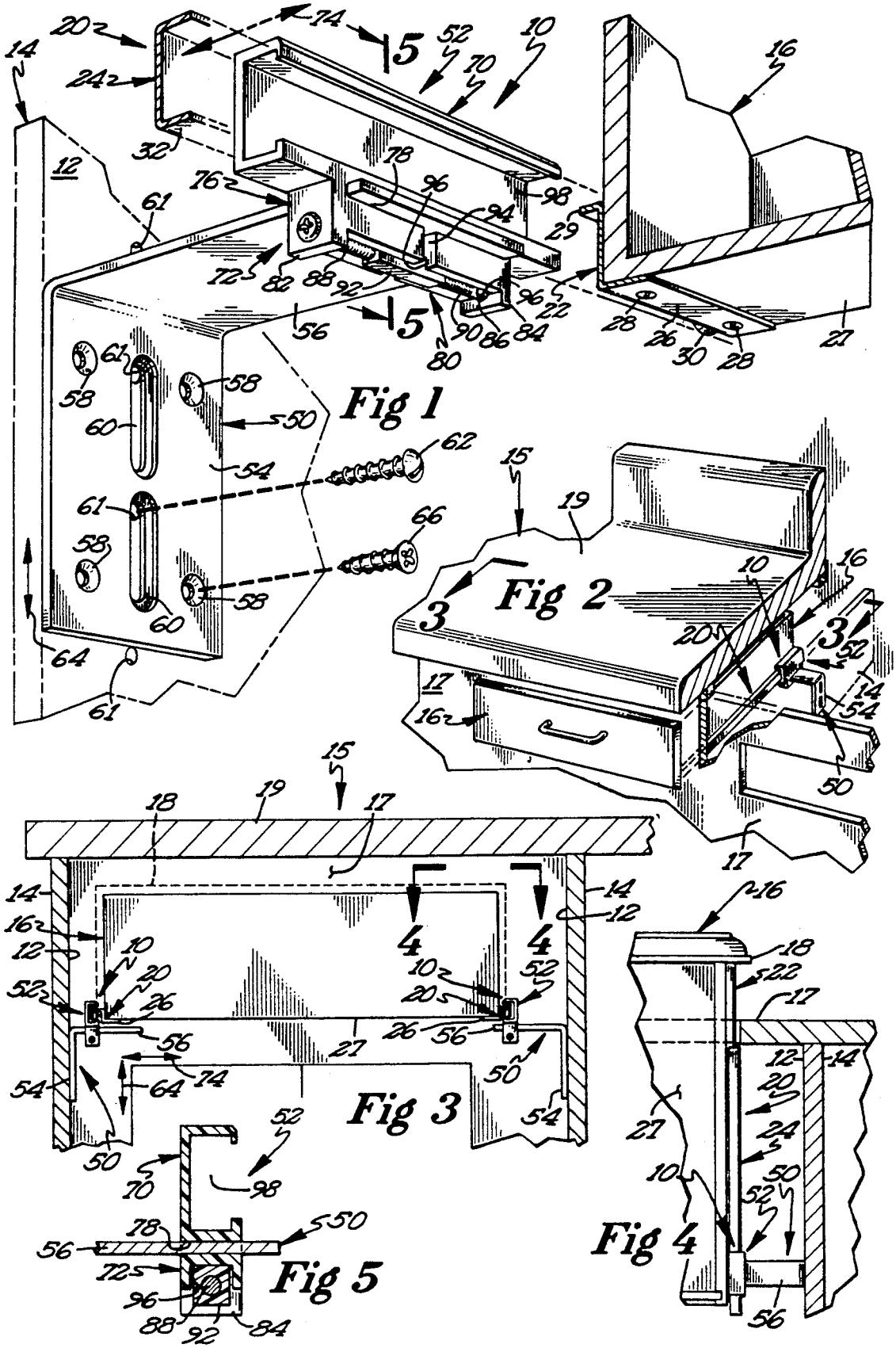
FIG. 1 is an upward looking perspective view of an embodiment of the present invention showing the obverse face of the invention so as to mount a drawer for sliding movement within a cabinet.
FIG. 2 is a downward looking perspective taken partially in section and showing the reverse face of the embodiment situated within the cabinet and supporting the drawer.
FIG. 3 is a vertical cross section taken along cutting plane 3—3 of FIG. 2 and showing a view of the cabinet looking from the rear of the cabinet forwardly with a drawer mounted for sliding movement into and out of the cabinet by a pair of apparatuses embodying the present invention.
FIG. 4 is a top view, taken partly in section, of the cabinet shown in FIGS. 2 and 3 and taken along cutting plane 4—4 of FIG. 3.
FIG. 5 is a partial cross sectional view taken along cutting plane 5—5 of FIG. 1.

FIG. 1 shows an embodiment of a drawer guide mounting apparatus 10 in accordance with the present invention. As shown, apparatus 10 is mounted to the interior wall surface 12 of a cabinet sidewall 14 shown in phantom in FIG. 1. Cabinet sidewall 14 is part of a cabinet 15 that is better seen in the partial views shown thereof in FIGS. 2–4. Cabinet 15 houses a drawer 16. Cabinet 15 may include a face frame 17 that, as shown in FIGS. 2–4, extends laterally from the side wall 14 so as to space the drawer 16 from the side wall 14. Drawer 16 slides into and out of the cabinet 15 through an opening 18 shown in dotted line in FIG. 3. Cabinet 15 is shown mounted below a countertop 19, shown in a partial cross-sectional view in FIG. 4, but it will be understood that the present invention is not limited to drawers found in cabinets installed in such locations.

Also shown in FIG. 1 is a partial cross sectional view of the rear portion of a drawer 16 mounted for sliding movement within the cabinet 15 by apparatus 10, which carries a drawer track assembly 20 that includes a drawer rail member and guide bar member 24. Drawer rail 22 and guide bar 24 cooperatively interact to facilitate the sliding movement of one side of the drawer 16 into and out of the cabinet 15 and support the drawer 16 therewithin. A second identical drawer track assembly 20 is utilized to support the second, or other, side of the drawer, but only the first such assembly will be described in detail herein. It will be understood that the description of the drawer track assembly 20 to follow is illustrative of the various types of supports available for such a purpose and that the present invention is not thereby limited by the particular embodiment of the assembly shown. As previously noted, some such assemblies include a third member interposed between the drawer rail 22 and guide bar 24 that facilitates the sliding movement of the drawer.

Drawer rail 22 regardless of its particular configuration, supportingly engages drawer 16. Thus, with the embodiment of such an assembly 20 as shown in the Figures, drawer rail 22 of the assembly 20 has a substantially Z-shaped cross section with a first flange 26 that supportingly engages the bottom 27 of the drawer 16 and that is attached thereto by screws 28. Guide bar 24, also regardless of its particular configuration, is supported by the cabinet side wall 14. Again, with the embodiment of such an assembly 20 as shown in the Figures, guide bar 24 has a substantially C-shaped cross section and is adjustably supported by mounting apparatus 10. Although not shown, the particular embodiment of the assembly 20 shown includes a freely rotatable wheel that is attached to the forward end of guide bar 24 and that engages second flange 29 of drawer rail 22 during sliding movement. Drawer rail 22 further includes a freely rotatable wheel 30 that engages the lower flange 32 of guide bar 24.

The drawer guide mounting apparatus 10 will now be described. It will be understood that mounting the drawer 16 for sliding movement will require at least two such assemblies, at least one on each side of the drawer, as best in FIG. 3, and that the description to follow will suffice to describe both assemblies. Thus each apparatus 10 includes a mounting member 50 and a carriage 52 that adjustably engages mounting member 50. Carriage 52 supports guide bar member 24.

As shown in the present embodiment mounting member 50 is configured as an L-bracket that includes first and second arms 54 and 56, respectively, angularly disposed relative to each other. First arm 54 is mounted to interior wall surface 12 of cabinet side wall 14. As shown, first arm 54 has a substantially planar configuration and includes a plurality, here four, of countersunk screw holes 58. First arm 54 further includes at least one elongate, generally upright countersunk adjustment slot 60. Two such slots are shown in the embodiment of FIG. 1. Adjustment slots 60 enable the cabinet maker to adjustably position drawer guide mounting apparatus 10 along the vertical axis of the cabinet. Thus, the cabinet maker may drill holes 61 in side wall 14 and attach mounting member 50 thereto by means of screws 62 inserted through adjustment slots 60 into the drilled screw holes 61. Holes 61 may be thirty-two millimeter (32 mm) on center, a conventionally used system. Thus, elongate slots 60 are appropriately sized such that each slot will engage one of the holes 61. That is, the top slot 60 will engage a hole 61 while the bottom slot 60 will engage the next lower hole. "Engage" in this sense means that member 50 can be positioned relative to a hole 61 such that a screw can be inserted through slot 60 into hole 61. Mounting member 50 may then be adjustably positioned within the extent defined by the slots 60 on a vertical axis as indicated by double headed arrow 64. When properly positioned along the vertical axis, mounting member 50 may be rigidly affixed in position by means of at least one screw 66 inserted through one of the countersunk holes 58. It should be understood that the foregoing is meant to be illustrative of a method and means for attaching mounting member 50 to the cabinet side wall 14 and that the present invention is not limited by the particular means chosen to attach the apparatus 10 to the cabinet side wall 14.

Second arm 56, as shown, has a substantially planar configuration and extends at generally a right angle inwardly from interior wall surface 12 to underlie drawer guide 24. Second arm 56 adjustably and supportably engages carriage 52. Carriage 52 includes a drawer guide retainer 70 for supportingly engaging guide bar member 24 of drawer track assembly 20. Carriage 52 further includes a securing means 72 for selectively securing carriage 52 to second arm 56. Mounting member 50 and carriage 52 may be manufactured from synthetic materials if desired.

Means 72 slidingly and adjustably engages second arm 56 so as to selectively secure carriage 52 to second arm 56 in the desired position so that the drawer 16 slides smoothly into and out of the cabinet 15. Thus, guide bar 24 of drawer track assembly 20 can be selectively positioned within cabinet 15 along a horizontal axis as indicated by double headed arrow 74. Means 72 includes a body portion 76 having a flexible passage 78 configured to sliding and adjustably receive second arm 56.

Means 72 further comprises a clamping means 80 for tightly clamping flexible passage 78 about second arm 56 when carriage 52 has been selectively positioned along the extent of second arm 56. As shown in the embodiment of FIGS. 1–4, clamping means 80 includes first and second flanges 82 and 84 extending from body portion 76 downwardly and substantially transversely to flexible passage 78. Each flange 82 and 84 includes a through hole 86 through which first and second threaded fasteners 88 and 90 are inserted into a threaded engagement with a threaded coupler 92. Coupler 92 has a central threaded bore and is engagable at opposite ends thereof by thread fastened fasteners 88 and 90. Clamping means 80 also includes a transverse slot 94 that intersects flexible passage 78 and that constricts or expands in width as fasteners 88 and 90 are turned into and out of coupler 92. The constriction or expansion of slot 94 allows flexible passage 78 to be tightened or loosened respectively around second arm 56, thereby providing an adjustable grip so that carriage 52 may be slidably positioned on second arm 56 in the desired location. As shown in the Figures, the body portion 76 includes a recess 96 into which coupler 92 is disposed. As best seen in FIG. 5, coupler 92 and recess 96 preferably each have a non-circular configuration such that coupler 92 does not rotate within recess 96 as fasteners 88 and 90 are turned into coupler 92, though circular configurations are also within the scope of the present invention. As shown, coupler 92 has a square cross section and recess 96 is appropriately configured with a similar configuration so that coupler 92 is received in a non-rotational orientation.

Drawer guide retainer 70 is slidably mounted to second arm 56 so as to position guide member 24 at a predetermined distance from the interior cabinet surface 12. In the embodiment shown in FIG. 1 drawer guide retainer 70 includes a channel 98 configured to snugly but slidably receive guide bar member 24. Channel 98 comprises means for slidably engaging and supporting guide bar member 24. Other means may be used to supportingly engage the guide bar member within the cabinet, but a means such as channel 98 enables the cabinet maker to easily position the guide bar member 24 of the drawer track assembly 20 as desired along the side to side direction of the cabinet as indicated by arrow 74. Channel 98 as shown has a C-shaped configuration to conform to the similarly shaped guide bar 24. Channel 98 could take on other configurations to match other types of guide bars and such configurations are within the scope of the present invention.

It will be understood that each apparatus 10 is substantially symmetric about a plane extending perpendicularly inwardly from wall 14 through adjustment slots 60. Because of this symmetry, apparatus 10 is reversible, that is, useable on both left and right sides of the drawer to support left and right guide bars without modification. This reversibility enables the cabinet maker to reduce inventory since only a single type of mounting apparatus is needed to mount the drawer. As shown in the Figures, first arm 54 is attached to surface 12 such that second arm 56 projects into the cabinet interior and arm 56 depends downwardly therefrom. Where space is limited, such as near the floor, member 50 can be inverted such that first arm 54 projects upwardly relative to second arm 56, rather than downwardly as shown.

In operation, during assembly of a cabinet, the cabinet maker will first attach a pair of mounting brackets 50 to an interior wall surface, such as the pair of brackets 50 shown in FIGS. 3 and 4, and will vertically position each bracket 50 such that the second arms 56 are at substantially the same vertical elevation, preferably so that the top of second arms 56 are at the same height as the bottom of the drawer opening. Each respective carriage 52 will then be installed by sliding the carriage 52 onto the second arm 56 such that the second arm 56 is slidably received by flexible passage 78 in the body portion 76. As shown in FIG. 3, each carriage 52 may then be slidingly positioned on its respective arm 56 such that the drawer 16 is mounted in the horizontal plane for proper sliding movement into and out of the cabinet. Thus, with the present invention, the guide bar 24 of the drawer track assembly 20 is adjustably positionable in both the vertical and horizontal axes as indicated generally by double headed arrows 64 and 74, as well as in the front/rear direction by the slidable engagement of guide bar 24 with channel 98.

When carriage 52 is properly positioned, clamping means 80 may be used to rigidly position the support body member relative to arm 56 and inner wall surface 12. That is, in the embodiment shown, the cabinet maker can through the use of the fasteners 88 and 90 threadably engaging the coupler 92 tighten the flexible passage 78 about arm 56 such that carriage 52 will be rigidly positioned on arm 56. Typically, when building the cabinet the artisan will position the carriage 52 in the shop through the adjustment of front fastener 88 and rear fastener 90. During installation, fastener 90 may not be readily accessible since it projects rearwardly and the rear of the cabinet will often be placed against a wall; front fastener 88, however, will be easily accessible since it faces forwardly. The present invention thus advantageously uses a pair of threaded fasteners that engage coupler 92 from opposite directions so as to enable the cabinet maker to adjust the positions of the carriage 52 on arm 56 from both the back and the front of the cabinet. The present invention, then, allows the cabinet installer to easily adjust the position of carriage 52 with a single screwdriver or other tool by adjusting a single fastener 88 or 90.

Furthermore, as shown in FIGS. 3 and 4, the present invention avoids the need of placing a shim for mounting the guide bar member 24 along the interior wall surface 12 when the cabinet 15 has a face frame 17 as indicated in the drawings. That is, as seen in those Figures, when a face frame is used, the drawer 16 is spaced from the side wall 14 such that the second member cannot be mounted directly to the side wall 14. The prior art mounting system would require the placement of a wooden shim along the interior wall surface of the cabinet to which the guide bar member 24 of the drawer track assembly 20 would be attached. The use of the shim was necessary in order to properly position the second member 24 away from the interior wall surface of the cabinet since the face frame 17 was used and the side of the drawer was not closely positioned relative to the interior wall surface of the cabinet. As noted earlier, this attachment was not adjustable and therefore if the cabinet 15 was installed at a location without level floors and plumb walls, the drawers could quickly become misadjusted.

Thus as shown and described the present invention provides an adjustable drawer guide mounting apparatus that is adjustable in both the horizontal and vertical directions to provide the cabinet maker with wide leeway in the design, construction and positioning of cabinet drawers. The present invention includes a mounting member and a carriage that slidably engages the mounting member and that supports a member the drawer track assembly. The mounting member and carriage are equally useful on both the left and right sides of the drawer for mounting the drawer guide, and thus the drawer, for sliding movement unlike most prior art devices. It will be understood that although drawer 16 has been shown and described as being mounted for sliding movement through the advantageous use of apparatus 10 on each side of the drawer, two or more may be used if desired or if required by the weight of the drawer and its anticipated contents. Another advantage of the present invention is that it does not require mounting to the rear wall of the cabinet or to a hanger disposed at the rear of the cabinet. It is therefore ideally suited for use in environments such as L-shaped counters or kitchen islands.

The present invention having thus been described, other modifications, alterations, or substitutions may now suggest themselves to those skilled in the art, all of which are within the spirit and scope of the present invention. It is therefore intended that the present invention be limited only by the scope of the attached claims below.

I claim:

1. A mounting apparatus useable with a cabinet and drawer for mounting the drawer for sliding movement relative to the cabinet, the cabinet having a plurality of interior wall surfaces, said apparatus comprising:

a pair of drawer track assemblies, each said assembly including at least first and second members, said first member attachable to the drawer and said second member supportable within the cabinet and slidingly engaged with said first member for supporting the drawer and for sliding movement relative to said first member, said assemblies useable to support the drawer on opposite sides thereof; and means for supporting each said second member within the cabinet, each said means for supporting including:

a mounting bracket, said bracket having a pair of arms angularly disposed relative to each other, a first one of said arms including means for mounting said bracket to the interior wall surface of the cabinet such that said second arm of said bracket extends inwardly from the cabinet interior wall surface;

a carriage for supporting said second member in spaced relation to the cabinet interior wall surface, said carriage being slidably engaged with said second arm; and means for selectively securing said carriage to said second arm at a predetermined position.

2. The apparatus of claim 1 wherein each said means for selectively securing includes:

a flexible passage configured to slidably receive said second arm; and means for clamping said passage about said second arm to rigidly affix said carriage to said second arm.

3. The apparatus of claim 2 wherein said carriage includes a channel configured to slidably receive said second member.

4. The apparatus of claim 1 wherein each said means for selectively securing comprises:

a body portion having a flexible passage configured to slidably receive said second arm; and means for clamping said passage about said second arm to rigidly affix said carriage to said second arm, wherein said means for clamping includes:

first and second flanges extending from said body portion substantially transversely to said passage, each said flange including a through hole;

first and second threaded fasteners insertable through said first and second through holes; and a threaded coupler engageable at opposite ends by said first and second threaded fasteners, whereby turning said first or second threaded fasteners into said threaded coupler causes said passage to flexibly engage said second arm.

5. The apparatus of claim 4 wherein said body portion includes a recess configured to receive said threaded coupler.

6. The apparatus of claim 4 wherein said clamping means includes means for retaining said threaded coupler in a non-rotational orientation relative to said body portion.

7. The apparatus of claim 6 wherein said means for retaining comprises a recess disposed in said body portion and configured to receive said threaded coupler, said threaded coupler and said recess having non-circular configurations.

8. The apparatus of claim 7 wherein said coupler has a substantially square cross sectional configuration.

9. The apparatus of claim 4 wherein said carriage includes a drawer guide retainer and said retainer and said body portion are integral.

10. A drawer guide mounting apparatus for mounting a drawer guide within a cabinet having a plurality of interior wall surfaces, said apparatus comprising:

a mounting bracket, said bracket having first and second arms angularly disposed relative to each other, said first arm being mountable to an interior wall surface of the cabinet such that said second arm of said bracket extends inwardly from the cabinet interior wall surface; and drawer guide retention means slidably mounted to said second arm to hold said guide at a predetermined distance from said first arm, said drawer guide retention means including:

means for selectively securing said guide retention means to said second arm, wherein said clamping means includes:

a body portion including a flexible passage configured to slidably receive said second arm; and means for clamping said flexible passage about said second arm to rigidly affix said drawer guide retention means to said second arm, wherein said means for clamping comprises:

slot means intersecting said channel such that said passage is flexible;

first and second flanges extending from said body portion substantially transversely to said passage, said flanges including respective first and second through holes;

first and second threaded fasteners insertable through said first and second through holes from opposite directions; and a threaded coupler engageable at opposite ends by said first and second threaded fasteners, whereby turning said first and second threaded fasteners into said threaded coupler causes said passage to flexibly engage said second arm by causing said slot means to narrow in size.

11. The apparatus of claim 10 wherein said body portion includes a recess configured to receive said threaded coupler.

12. The apparatus of claim 11 wherein said clamping means includes means for retaining said threaded coupler in a non-rotational orientation relative to said body member.

13. The apparatus of claim 12 wherein said means for retaining comprises a recess disposed in said body portion and configured to receive said threaded coupler, said threaded coupler and said recess having non-circular configurations.

14. The apparatus of claim 13 wherein said coupler has a substantially square cross sectional configuration.

15. The apparatus of claim 14 wherein said drawer guide retention means and said body portion are integral.

16. The apparatus of claim 10 wherein the drawer guide includes at least first and second members, the first member attachable to a drawer and the second member supportable within the cabinet and slidingly engaged with the first member for supporting the drawer and for sliding movement relative to the first member, wherein said drawer guide retention means includes a channel configured to slidably receive said second member.

* * * * *

UNITED STATES PATENT AND TRADEMARK OFFICE

CERTIFICATE OF CORRECTION

PATENT NO. : 5,310,255
DATED : May 10, 1994
INVENTOR(S) : Paul A. Ranallo

It is certified that error appears in the above-indentified patent and that said Letters Patent is hereby corrected as shown below:

In the Claims: Column 8, Line 58: delete "clamping" and substitute --securing--.

Column, 8, Line 67: delete "channel" and substitute --flexible passage--.

Column 9, Line 20: delete "member" and substitute --portion--.

Signed and Sealed this

Second Day of January, 1996

Bruce Lehman

*Attest:*

BRUCE LEHMAN

*Attesting Officer*

*Commissioner of Patents and Trademarks*